US008881403B2

(12) United States Patent
Gobbato et al.

(10) Patent No.: US 8,881,403 B2
(45) Date of Patent: Nov. 11, 2014

(54) PROCESS FOR PRODUCING OPENABLE PHOTOGRAPH HOLDERS

(75) Inventors: Lorenzo Gobbato, Camisano Vicentino (IT); Morena Gobbato, Camisano Vicentino (IT)

(73) Assignee: M.P.M. di Gobbato Enzo—S.R.L., Vicenza (IT)

( * ) Notice: Subject to any disclaimer, the term of this patent is extended or adjusted under 35 U.S.C. 154(b) by 244 days.

(21) Appl. No.: 13/471,295

(22) Filed: May 14, 2012

(65) Prior Publication Data

US 2013/0219684 A1 Aug. 29, 2013

(30) Foreign Application Priority Data

Mar. 23, 2012 (IT) ..... PD2012A0089

(51) Int. Cl.
*A44C 27/00* (2006.01)

(52) U.S. Cl.
USPC ..... 29/896.4; 29/11; 63/18; 63/19

(58) Field of Classification Search
USPC ..... 29/11, 896.4; 24/633; 63/2, 21; 101/27, 101/31; 156/219
See application file for complete search history.

(56) References Cited

U.S. PATENT DOCUMENTS

| | | | | |
|---|---|---|---|---|
| 2,740,662 | A | 1/1954 | Scott | |
| 4,581,088 | A * | 4/1986 | House | 156/219 |
| 6,249,942 | B1 * | 6/2001 | Schmid | 29/11 |
| 2007/0295028 | A1 | 12/2007 | Talmor | |
| 2010/0251769 | A1 | 10/2010 | Samuels | |

FOREIGN PATENT DOCUMENTS

| | | | |
|---|---|---|---|
| DE | G9212807.6 | U1 | 2/1993 |
| EP | 0540875 | A1 | 5/1993 |
| GB | 2379593 | A | 6/2003 |

* cited by examiner

*Primary Examiner* — Richard Chang
(74) *Attorney, Agent, or Firm* — Hedman & Costigan, P.C.; James V. Costigan; Kathleen A. Costigan

(57) ABSTRACT

A process for producing openable photograph holders by providing a laminar sheet made of metallic material, plastically deforming by molding the laminar sheet to obtain a first semi-finished piece and a second semi-finished piece having a profile substantially equal to the profile of the first semi-finished piece, arranging a pair of shaped bottoms having profiles substantially equal each other and to the profile of the semi-finished pieces, removing material in the first semi-finished piece of rounded shape to form an ornamental pattern. One shaped bottom is coupled to each semi-finished piece to form two half portions of the openable holder, each of which presents an outer surface and an inner surface to house a photo, and constraining together the half portions to form the openable photograph holder in which the inner surface of a first half portion faces the inner surface of a second half portion.

20 Claims, 3 Drawing Sheets

PROCESS FOR PRODUCING OPENABLE PHOTOGRAPH HOLDERS

The present invention concerns a process for producing openable photograph holders, mostly of substantially miniaturized type and suitable to form chains, necklaces, bracelets, bangles or earrings pendants in the jewelry, goldsmith and/or trinkets field.

It is known that jewelry, goldsmith and/or trinkets and/or the like jewels which can be worn by people are from time out of mind manufactured according to various fashions, shapes, combinations of lines, colors and, more generally, according to countless aesthetic effects.

Within jewelry, goldsmith and/or trinkets and/or the like jewels the openable photograph holders are clearly distinguishable and identifiable, usually of the reduced shaped compared to a traditional table photo graph holder and typically suitable to be coupled with a necklace, a chain, a bracelet or an earring to form a classic pendant in which at least one small photo, of personal choice, can be housed.

Even within the category of the openable photograph holders the versions available on the market are several, varied not only on the basis of the type of metallic material, usually precious, which they are produced with, but also on the basis of the aesthetic effects or ornamental patterns defined on the outer surface of at least one of the half portions forming the openable photograph holders concerned and that, as known, are rotatably coupled each other in order to define for the openable photograph holder a closed position, in which the inner surfaces of the half portions are hidden and fully facing each other, and at least one opened position in which the inner surfaces of the half portions are turned outwardly and, therefore, at sight.

In particular, for some years by now the producers of jewelry, goldsmith and/or trinkets have been offering models of openable photograph holders in which at least the outer surface of at least one of the half portions presents a plurality of blind and/or through incisions that remain at sight and which, by breaking the linearity and uniformity of the aesthetic effect of the oldest and traditional openable photograph holders, create a specific product line, well distinct and rather surprising and attractive for customers, while moving from the same semi-finished pieces and from the same base production technologies.

The same applicant of the present invention is well known in the goldsmith field for producing openable photograph holders provided with the aesthetic features just cited, namely constituted by the blind and/or through incisions made in at least one of the half portions.

However, the processes currently implemented in the goldsmith sector for the production of openable photograph holders have the widely recognized and ascertained limit to prevent the incisions extend also at the side edge of the semi-finished pieces that, together with the corresponding shaped bottoms which are firmly coupled with, form each of the two half portions of the openable photograph holders.

This depends on the fact that, in the processes of the prior art, the blind and/or through incisions are made in an initial stage and directly on the traditional starting flat laminar sheet, and, consequently, the bending or cambering of the laminar sheet, that originates the abovementioned semi-finished pieces to be coupled with the shaped bottoms, takes place only after these incisions have been already made.

The aesthetic effect given by the blind and/or through incisions (or cuts) is therefore inevitably interrupted at the side edges of the two half portions of the openable photograph holders of known type: this practical situation is suffered and necessarily accepted by the market of the sector, although it is not fully appreciated by the same.

A second and not last limit of the known processes for producing openable photograph holders is represented by the laboriousness of the operations that must be carried out to get the finished product, primarily determined by the manual execution of the bending or cambering of the laminar sheet after it has been engraved.

Starting therefore from the knowledge of the abovementioned drawbacks of the prior art, the present invention intends to fully remedy them.

In particular, main purpose of the present invention is to implement a process for producing openable photograph holders, mainly of goldsmith, jewelry and/or trinkets, which allows to extend the blind and/or through incisions also at the perimetric or side edge of the half portions rotatably coupled each other and forming the opening photograph holders themselves.

Within said purpose, it is task of the present invention to implement a process for producing openable photograph holders that, compared to the prior art, increases the continuity and the uniformity of the aesthetic effect provided by blind and/or through incisions made in the outer surface of at least one of the half portions of the openable photograph holders.

It is another task of the invention to develop a process that leads to obtain openable photograph holders which have a degree of desirability at the market greater than that one of the openable photograph holders of known type.

It is a second purpose of the current invention to indicate a process for producing openable photograph holders which presents an articulation simpler and more linear than that one of equivalent known processes, such that to be reflected in a reduction of times and costs for the manufacture of opening photograph holders.

Said purposes are achieved by a process for producing openable photograph holders as the claim 1 attached hereto, as hereinafter referred for the sake of brevity of exposition.

Further applicative features of detail of the process of the invention are contained in the corresponding dependent claims.

The aforesaid claims, hereinafter specifically and concretely defined, are considered integral part of the present description.

Advantageously, the process for producing openable photograph holders suitable in particular to form jewels of goldsmith, jewelry and/or trinkets, which is the object of the invention, allows to extend also to the perimetric or side edge of the photograph holders themselves the blind and/or through incisions, without compromising the structural integrity of thin filaments of metallic material delimiting these incisions present in the outer surface of the half portions of the openable photograph holders.

This thanks to the fact that the semi-finished pieces are firstly cambered during the processing of plastic deformation of molding and only subsequently submitted to a detailed and precise operation of removal of material that results in the creation of the blind and/or through incisions.

Still advantageously, the process of the present invention leads to the production of photograph holders more easily and quickly than the equivalent processes of the prior art, just mainly on the basis of the specific operations with which, in the order, the cambering of the semi-finished pieces and the removal of material from at least one of them are obtained.

Equally advantageously, the photograph holders directly obtained with the process of the present invention exhibit blind and/or through incisions, distributed on the entire outer surface of at least one of the relative half portions on which they are made, in a way more homogeneous and uniform than to the photograph holders obtained through the processes of the prior art, in respect of which they have a better or still more attractive aesthetic effect and able to satisfy more fully the increasingly demanding and distinctive customer requests.

Said purposes and advantages, as well as others that will emerge later on, will appear to a greater extent from the detailed description that follows, relating to a preferred applicative embodiment of the process for producing openable photograph holders, which is the object of the invention, given by indicative and illustrative, but not limitative, way with reference to the accompanying drawing tables in which:

The process for producing an openable photograph holder, of miniaturized shape and suitable to constitute for example a pendant of a necklace or an earring, is thus schematically and illustratively depicted in the attached FIGS. 1A-11B.

Figure 12:
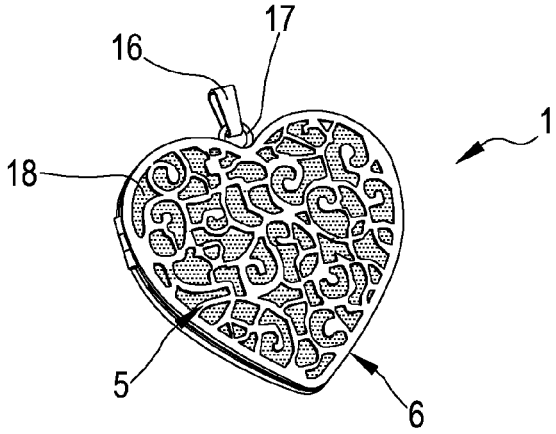
FIG. 12 is a front perspective view, in closure condition, of the openable photograph holder obtained through the process of the invention.

In the following, the openable photograph holder 1 obtained with the process of the invention is shown in FIG. 12 where it is generically numbered with 1.

Figure 1A:
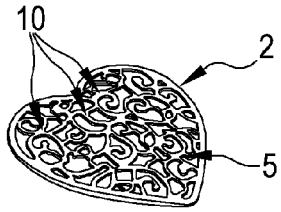
FIG. 1A is a perspective front view of a front piece of a photograph holder.
Figure 1B:
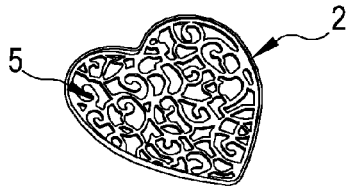
FIG. 1B is a perspective back view of a front piece of a photograph holder.
Figure 2:
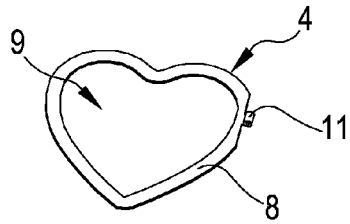
FIG. 2 is a perspective view of a shaped bottom piece of a photograph holder.
Figure 4:
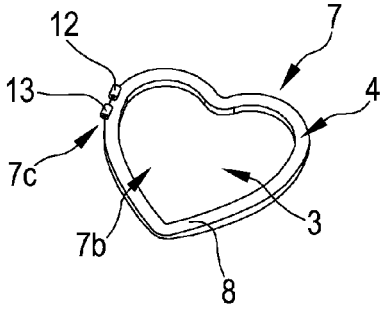

According to the invention, the process comprises the following operations:

providing a laminar sheet made of metallic material, not shown;

plastically deforming by molding the laminar sheet in such a way to obtain a first semi-finished piece 2 of rounded or deep drawn shape, visible in the FIGS. 1A and 1B, and a second semi-finished piece 3, substantially visible in FIG. 4, having a profile substantially equal to the profile of the first semi-finished piece 2;

arranging a pair of shaped bottoms 4, visible in FIG. 2, made of metallic material and having profiles substantially equal each other and to the profile of the semi-finished pieces 2, 3;

removing material in or from the first rounded semi-finished piece 2 in such a way as to get an ornamental pattern 5 which remains at sight while using the openable photograph holder 1;

firmly coupling the shaped bottoms 4 one for each of the semi-finished pieces 2, 3 so as to form two half portions 6, 7, visible respectively in FIG. 3 and FIG. 4, of the openable photograph holder 1, each of which presents an outer surface 6*a*, 7*a*, which remains at sight in any condition of use of the openable photograph holder 1, and an inner surface 6*b*, 7*b* responsible for housing a photo (not shown in the following figure);

rotatably constraining together the half portions 6, 7, for example according to the series of operations illustrated in the FIGS. 5, 6, 7A, 7B, so as to form the openable photograph holder 1 and define for the openable photograph holder 1 a closed position (visible in FIG. 12), in which the inner surface 6*b* of a first half portion 6 is entirely facing and substantially close to the inner surface 7*b* of a second half portion 7, and at least one opened position (substantially visible in the FIGS. 9A and 9B) in which the inner surface 6*b*, 7*b* of the half portions 6, 7 is turned outwardly and at sight.

More precisely, the operation of plastically deforming by molding said laminar sheet occurs in vertical action presses, for example hydraulic, mechanical or hydro-forming ones.

The rounded shaped of the first semi-finished piece 2 (so-called also lid) obtained through the operation of plastically deforming by molding the laminar sheet is, by purely preferred way, slightly bent back at the perimetric edge so as to determine with greater detail the wall of coupling of the first semi-finished piece 2 with the correspondent shaped bottom 4.

In a preferred manner but not binding way, the metallic material of the laminar sheet (and therefore of the semi-finished pieces 2, 3 derived therefrom) and/or shaped bottoms 4 is any one of the precious metals selected from the group consisting of gold, silver, palladium and platinum, in their various and possible colors and purity measures (carats) which they are commonly available or presented on the reference market with.

Advantageously, the process of the invention includes an operation of calibration of the laminar sheet, performed before the operation of plastically deforming by molding the laminar sheet itself: the objective of such an operation is to make the sizes (namely, the thickness) of the laminar sheet uniform along its entire surface extension and favor the effective implementation, using the equipment and appliances provided, of the procedural steps subsequent to it.

In particular, the operation of calibration of the laminar sheet includes an initial operation of longitudinal rolling of the opposite faces of the laminar sheet and a subsequent operation of control of the laminar sheet thickness, performed in a number of sample points of aforesaid opposing faces.

It should be noted that the laminar sheet usually presents a length not exceeding 90 cm, preferably equal to 50 cm.

Also the operation of arranging the shaped bottoms 4 includes in this case a plastic deformation of molding performed on the laminar sheet together with the plastic deformation of molding which the semi-finished pieces 2, 3 are obtained with.

Preferably but not necessarily, each of the shaped bottoms frame 4 comprises a laminar frame 8 which delimits a central through opening 9.

The process object of the invention preferably comprises an operation of computer graphics processing that creates a virtual image (visible at the video of a computer) of the ornamental pattern 5, performed before the operation of removing material in the rounded first semi-finished piece 2 in such a way to delimit with the utmost precision boundaries of the surface areas on which the actual operation of removing material has to be performed.

Furthermore, the process of the invention includes an operation of supporting the rounded first semi-finished piece 2, performed before the operation of removing material in the mold and rounded first semi-finished piece 2 after it is removal from the working press in order to firmly and temporarily keep it in a given still position.

More in detail, the operation of supporting the rounded first semi-finished piece 2 consists in inserting the mold and rounded semi-finished piece 2 into one of the counter-shaped imprints made in a throwaway matrix, not represented in the following figures for simplicity of exposition and which, in a preferred but not exclusive way, is made of brass and presents a rectangular profile of dimensions 65×80 cm.

According to the preferred applicative embodiment described herein of the process of the invention, the operation of removing material in the first semi-finished piece 2 is performed by means of a precision laser machine which makes blind and/or through incisions 10 in the side face of the first semi-finished piece 2 according to the virtual image of the ornamental pattern 5 stored in the memory of the computer.

In an advantageous but not exclusive manner, the process of the present invention also comprises an operation of finishing with a magnetic sleeve (or barrel)—tumbling—the rounded first semi-finished piece 2, performed after having removed the material in order to get the ornamental pattern 5 and before firmly coupling the shaped bottoms 4 with the semi-finished pieces 2, 3: the tumbling allows to remove the remaining portions of substrate of metallic material created during the execution of the blind and/or through incisions 10.

By purely indicative way, the operation of coupling the shaped bottoms 4 with the semi-finished pieces 2, 3 (one of which is rounded, in this case, as mentioned) comprises a welding which is performed at the outer perimetric edge of the shaped bottoms 4 and semi-finished pieces 2, 3 and in operating conditions (such as typically the temperature) which depend on the type of metallic material the semi-finished pieces 2, 3 and shaped bottoms 4 are made of.

In the specific case, the welding operation takes place while keeping advantageously the semi-finished pieces 2, 3 and shaped bottoms 4 slightly inclined with respect to a horizontal and vertical plane in such a way as to access the welding zones in a more precise and localized manner and thus avoid that the weld material of the welding interests and irreparably damages said ornamental pattern 5.

Conveniently, the operation of coupling the shaped bottoms 4 with the semi-finished pieces 2, 3 also includes an operation of applying a locking and shielding liquid at the zone that surrounds the outer perimetric edge of the shaped bottoms 4 and semi-finished pieces 2, 3, performed immediately before the operation of welding in order to limit its invasive, both thermal and mechanical, effects and prevent the weld material of the welding interests and damages the ornamental pattern 5.

The locking and shielding liquid of the welding is commercially available and is known to the skilled man of welding techniques.

Figure 3:
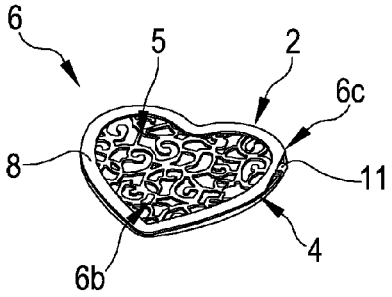
FIG. 3 is a rear perspective view of the front piece of FIG. 1A fastened to the bottom piece of FIG. 4 is a front perspective view of a bottom piece fastened to a semi-finished piece of a photograph holder.
Figure 5:
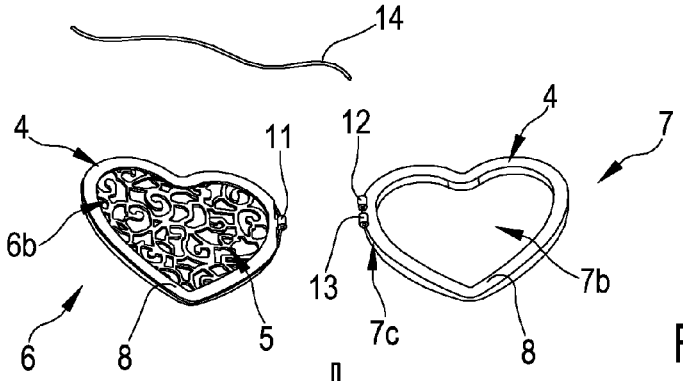
FIG. 5 is a perspective view of the elements of FIGS. 3 and 4 show how the different elements are assembled with a connecting wire and hinges.
Figure 6:
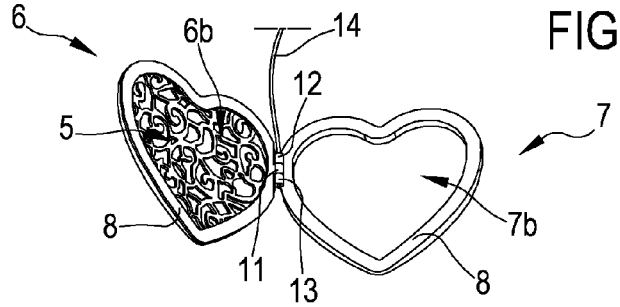
FIG. 6 show the elements of FIG. 5 with the hinges assembled and a connecting wire in position.
Figure 7A:
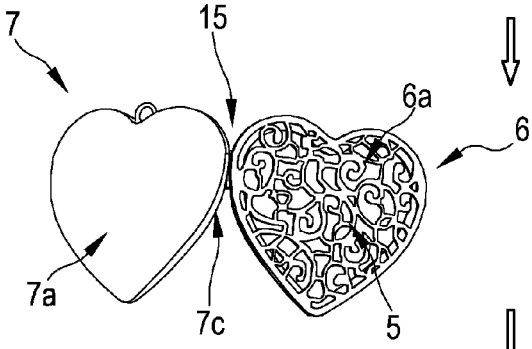
FIG. 7A is a back view of FIG. 6 with the connecting wire trimmed to fit the hinge and a link in place.
Figure 7B:
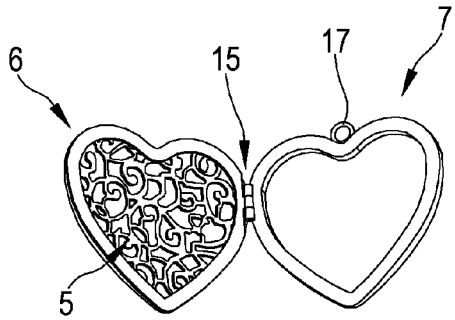
FIG. 7B is a front view of FIG. 6 with the connecting wire trimmed to fit the hinge and a link in place.

With reference to the operation to firmly constraining together the half portions 6, 7 that, materially, form the openable photograph holder 1, it comprises the following operations:

- welding a main ring 11 to a first shaped bottom 4 in such a way that the main ring 11 protrudes from the side edge 6*c* of the first half portion 6 when the first shaped bottom 4 has been coupled with the first semi-finished piece 2, as illustrated in FIGS. 3 and 5;
- welding two auxiliary rings 12, 13 substantially coaxial and spaced apart each other to a second shaped bottom 4 in such a way that the auxiliary rings 12, 13 protrude from the side edge 7*c* of the second half portion 7 when the shaped bottom 4 has been coupled with the second semi-finished piece 3, as illustrated in FIGS. 4 and 5;
- bringing the half portions 6, 7 near each other in such a way that the main ring 11 is interposed between the auxiliary rings 12, 13 and coaxial to them, according to what has been glimpsed by FIG. 5;
- inserting a wire 14, made for example of precious metal, into the main ring 11 and the auxiliary rings 12, 13, according to what it is illustrated in FIG. 6;
- by using for example an indium and palladium-based welding alloy, welding the opposite ends of the wire 14 to the side edge 7*c* of the half portion 7 so that the assembly thus obtained forms a rotation hinge, as a whole indicated with 15 in FIGS. 7A and 7B.

The operating trick of welding the ends of the wire 14 to the side edge 7*c* of the only half portion 7 allows to further limit the risk that the welding ends up with interesting and potentially affecting at least in part the aesthetic effect offered by the ornamental pattern 5 present in the other half portion 6.

This does not exclude that, in other applicative solutions of the process of the invention, through appropriate, well studied and careful operating precautions, the opposite ends of the wire are welded to the side edge of both half portions of the openable photograph holder which is under production.

Also the operation of firmly constraining together the half portions 6, 7, preferably, comprises an operation of applying a locking and shielding liquid (similar to that one previously mentioned) at the area surrounding the rotation hinge 15, performed immediately before the operation of welding in order to limit the invasive, both thermal and mechanical, effects thereof.

Figure 8:
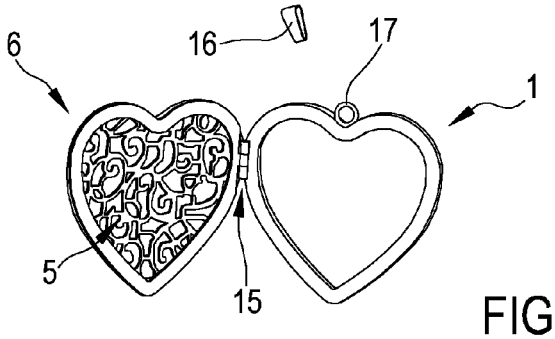
FIG. 8 is a view of FIG. 6 with a counterlink for attachment to the link.

FIG. 8 highlights how the process of the invention provides the operation of coupling a classical counter-link 16 to link 17 already welded, in this case, to the half portion 7 devoid of ornamental pattern: this depending on the fact that the openable photograph holder which can be predominantly obtained through the process here described and claimed in exclusive is, in general, represented by a pendant suitable to be applied to a necklace, a chain, an earring or a bracelet.

Preferably but not necessarily, the process of the present invention also comprises an operation of final finishing, performed downstream the operation of firmly constraining together the half portions 6, 7.

More in detail, the above-mentioned final finishing operation consists, in this case, in a brush polishing performed without any manipulation by the operator of the half portions 6, 7 constrained together, positioning the half portions 6, 7 on suitable support means, not visible and made of for example wood or potassium alum (also known as rock alum): the use of the support means on which supporting the half portions 6, 7 constrained together makes it convenient though not essential in order to prevent crushing or distortions of the half portion 6 structurally weakened by the presence of the incisions 10.

Figure 9A:
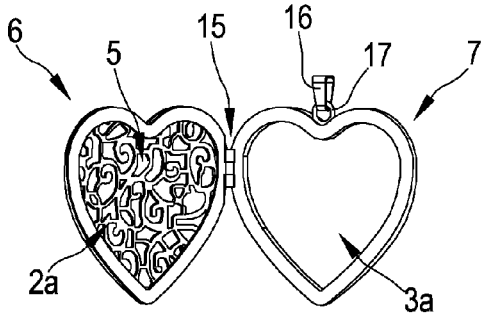
FIG. 9A is a front perspective view of FIG. 8 with the counterlink attached to the link.
Figure 9B:
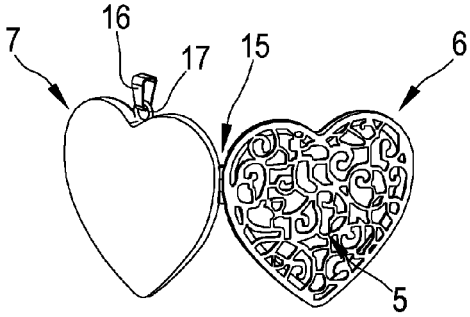
FIG. 9B is a rear view of FIG. 8 with the counterlink attached to the link.

The result of the polishing operation is illustrated in FIGS. 9A and 9B showing from opposite sides the article still under working, not yet completed in this specific example.

Figures 10A, 10B:
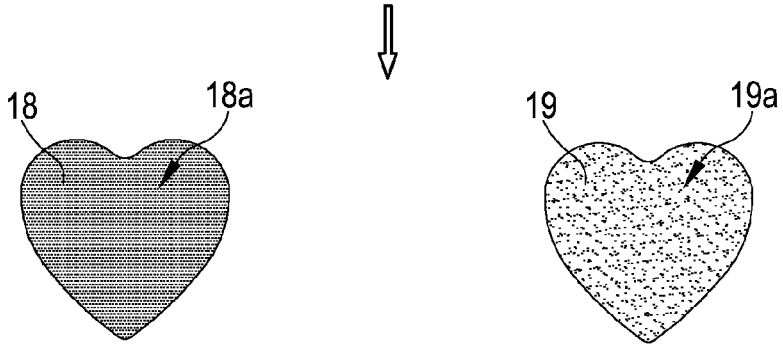
FIG. 10A is a front view of a shaped insert for an inner surface of the photograph holder.
FIG. 10B is a front view of a shaped insert for an inner surface of the photograph holder.

Indeed, the process object of the invention further comprises an operation of applying a decorative shaped insert 18, 19, shown in FIGS. 10A and 10B and having a profile substantially equal to that one of the semi-finished pieces 2, 3 and the shaped bottoms 4, to the inner surface 6*b*, 7*b*, respectively, of the half portions 6, 7 and an operation of fixing the decorative shaped insert 18, 19 to the inner surface 6*b*, 7*b* of the half portions 6, 7.

Figures 11A, 11B:
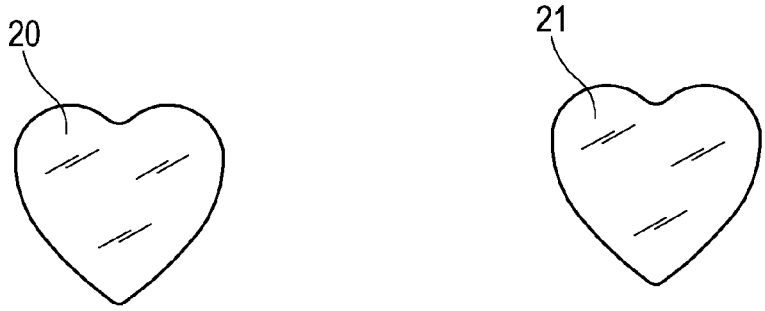
FIG. 11A is a front view of a transparent protective insert for use with the insert of FIG. 10A.
FIG. 11B is a front view of a transparent protective insert for use with the insert of FIG. 10B.

This last operation of fixing is carried out by superiorly coupling with the decorative shaped insert 18, 19 a removable protection 20, 21, visible in FIGS. 11A and 11B and made of transparent material (for instance plexiglas) in order to allow, on one hand, the view of the photo that is interposed between the decorative shaped insert 18 and the relative removable protection 20 and, on the other hand, the mere visual appreciation of the decorative shaped insert 19.

In the specific case, the operation of applying the decorative shaped insert 18, 19 to the inner surface 6*b*, 7*b* of the respective half portion 6, 7 consists of placing the aforesaid decorative shaped insert 18, 19 into the central through opening 9 of the laminar frame 8 which form each of the shaped bottoms 4, up to place it close to the inner face 2*a*, 3*a* of the semi-finished pieces 2, 3.

In turn, the operation of fixing the decorative shaped insert 18, 19 to the inner surface 6*b*, 7*b* of the respective half portion 6, 7 consists of, in this case, the insertion or snap, pressure, forcing the removable protection 20, 21 into the central through opening 9 of the laminar frame 8 up to place it close to the outer face 18*a*, 19*a* of the respective decorative shaped insert 18, 19.

The decorative shaped insert 18, 19 includes, by way of pure example, a laminar piece of monochrome, multi-chrome and/or bearing fancy designs made at will colored cloth.

In the coupling system of the decorative shaped inserts 18, 19 with the inner surface 6*b*, 7*b* of the respective half portion 6, 7 and in their keeping in fixed position by means of the removable protection 20, 21 resides another important advantage of the invention: indeed, these operating precautions allow an end user (the customer or retailer) to change at will (at any time and on the basis of the fancy needs) the type of decorative shaped insert coupled with at least one of the half portions of the openable photograph holder and, in last analysis, the overall aesthetic effect provided by the latter, by reason of the fact that at least the through incisions allow to at least partly vision the decorative shaped insert.

In essence, therefore, the decorative shaped insert is easily and quickly interchangeable, thanks to its simple juxtaposition to the inner face of at least one of the semi-finished pieces and the removability of the protection of a transparent material which, once completed the process of the invention, keeps it firmly in position.

This advantageously reflects in a convenient interchangeability of the overall aesthetic effect of the openable photograph holder obtained through the process of the invention: a single finished base article—as shown in FIGS. 9A and 9B—of an openable photograph holder produced with the process of the invention thus allows, with a simple and quick replacement of the decorative shaped insert coupled with it, to determine a wide variety of aesthetic effects and to obtain a finished product very versatile in use, with the obvious advantages that this entails both in terms of production and in terms of meeting the increasingly demanding, particular and often surprising requirements of the customers of goldsmith, jewelry and/or trinkets sector.

It is understood that in other applicative embodiments of the invention process, not accompanied by explanatory drawings, the operation of coupling with the decorative shaped insert could interest the inner surface of only one of the half portions of the openable photograph holder and, therefore, the operation of fixing such a decorative shaped insert could be performed by coupling with the inner surface only one removable protection made of transparent material.

Based on the foregoing, it is understood, therefore, that the process for producing openable photograph holders of the present invention achieves the objects and reaches the advantages previously mentioned.

During application, changes could be made to the process for producing openable photograph holders of the invention consisting, for example, in an operation of removing material performed on both the semi-finished pieces, obtained by plastic deformation of molding of the laminar sheet, in order to get a double ornamental pattern that remains visible during use of the openable photograph holder.

In addition, in other applications of the invention, the process for producing openable photograph holders could include an operation of removing material from the first semi-finished piece and/or the second semi-finished piece different from that one previously described.

Moreover, further applicative embodiments of the process claimed herein could provide that through the operation of plastic deformation by molding of the starting laminar sheet it is possible to get a plurality of first semi-finished pieces, having profiles equal or different each other, and a plurality of as many seconds semi-finished pieces, having profiles equal or different each other but still equal to those ones of the corresponding first semi-finished pieces which must be coupled with, which does not affect the advantage brought by the present invention.

It should be noted that, unlike what has been described above for the preferred embodiment of the invention, even the second semi-finished piece may present rounded (or deep-drawn or with a convex outer surface) shape as a result of the plastic deformation by molding of the laminar sheet made of metallic material.

It is, also, stated precisely that further application embodiments of the process of the invention could provide that the shaped bottoms to be coupled with the semi-finished pieces to form the half portions of the openable photograph holder are not necessarily obtained through plastic deformation by molding, but through other proper operation suitable for the purpose.

Furthermore, other applications of the process of the invention could exist in which only one of the half portions of the openable photograph holder is provided with an inner surface suitable to house a photo.

Finally, the metallic material of the shaped bottom (in the case described above constituted, as seen, by a laminar frame) and laminar sheet (and therefore of the semi-finished pieces obtained from this) could be either equal or different each other, provided that they are technically compatible to be coupled: this according to the aesthetic requirements chosen for a predefined openable photograph holder.

It is, finally, clear that many other variations may be made to the process for producing openable photograph holders concerned, without departing from the principle of novelty intrinsic in the inventive idea expressed here, as it is clear that, in the practical implementation of the invention, materials, shapes and sizes of the illustrated details can be changed, as needed, and replaced with others technically equivalent.

Where the constructive features and techniques mentioned in the following claims are followed by reference numbers or signs, those reference signs have been introduced with the sole objective of increasing the intelligibility of the claims themselves and therefore they have no limiting effect on the interpretation of each element identified, by way of example only, by these reference signs.

The invention claimed is:

1. A process for producing an openable photograph holder (1) comprising the following operations:

providing a laminar sheet made of metallic material;

plastically deforming by molding said laminar sheet in such a way as to obtain at least one first semi-finished piece (2) of rounded or deep-drawn shape and at least one second semi-finished piece (3) having a profile substantially equal to a profile of said first semi-finished piece (2);

arranging a pair of shaped bottoms (4) made of metallic material and having profiles substantially equal to each other and to said profile of said semi-finished pieces (2, 3);

firmly coupling said shaped bottoms (4) one for each of said semi-finished pieces (2, 3) so as to form two half portions (6, 7) of said openable photograph holder (1), each of which presents an outer surface (6*a*, 7*a*) suitable to remain visible in any condition of use of said openable photograph holder (1) and at least one of which presents an inner surface (6*b*, 7*b*) suitable to house a photo;

rotatably constraining together said half portions (6, 7) so as to form said openable photograph holder (1) and define for said openable photograph holder (1) a dosed position, in which said inner surface (6*b*) of a first of said half portions (6, 7) is entirely facing and substantially close to said inner surface (7*b*) of a second of said half portions (6, 7), and at least one opened position in which said inner surface (6*b*, 7*b*) of said half portions (6, 7) is visible, characterized in that said process comprises an operation of removing material at least in said first semi-finished piece (2) of rounded shape in such a way as to create blind and/or through incisions (10) which extend to the perimetric or side edge of said first semi-finished piece (2) and to provide an ornamental (5) suitable to remain at sight while using said openable photograph holder (1), said operation of removing material at least in said first semi-finished piece (2) of rounded shape being performed after said operation of plastically deforming by molding said laminar sheet with which said at least one first semi-finished piece (2) of rounded or deep-drawn shape and said at least one second semi-finished piece (3) having a profile substantially equal to the profile of said first semi-finished piece (2) are obtained.

2. The process according to claim 1, characterized in that said operation of plastically deforming by molding said sheet occurs in vertical action presses.

3. The process according to claim 1, characterized in that said rounded shape of at least said first semi-finished piece (2) obtained through said operation of plastically deforming by molding said laminar sheet is slightly bent at the perimetric edge.

4. The process according to claim 1, characterized in that said metallic material of said laminar sheet and/or said shaped bottoms (4) is any one of the precious metals selected from the group consisting of gold, silver, palladium and platinum.

5. The process according to claim 1, characterized in that it comprises an operation of calibration of said laminar sheet, performed before said operation of plastically deforming by molding said laminar sheet and is suitable to standardize sizes of said laminar sheet along its entire surface extension.

6. The process according to claim 5, characterized in that said operation of calibration of said laminar sheet includes an initial longitudinal rolling operation of the opposite faces of said laminar sheet and a subsequent control operation of the thickness of said laminar sheet carried out at various sample points of said opposite faces.

7. The process according to claim 1, characterized in that said operation of arranging said shaped bottoms (4) includes a plastic deformation of molding performed on said laminar sheet contextually to said plastic deformation of molding which said semi-finished pieces (2, 3) are obtained with.

8. The process according to claim 1, characterized in that at least one of said shaped bottoms (4) comprises a laminar frame (8) delimiting a central through opening (9).

9. The process according to claim 1, characterized in that it includes an operation of computer graphics processing that creates a virtual image of said ornamental pattern (5), performed before said operation of removing material in at least said rounded first semi-finished piece (2) in such a way as to delimit with the utmost precision boundaries of the surface areas on which said operation of removing material has to be performed.

10. The process according to claim 9, characterized in that said operation of removing material at least in said first semi-finished piece (2) is performed by means of a precision laser machine which makes blind and/or through incisions (10) in the side face of at least said first semi-finished piece (2) according to said virtual image of said ornamental pattern (5) stored in the memory of a computer.

11. The process according to claim 1, characterized in that it includes an operation of supporting at least said rounded first semi-finished piece (2), performed before said operation of removing material in at least said mould and rounded first semi-finished piece (2) in order to firmly and temporarily keep it in still position.

12. The process according to claim 11, characterized in that said operation of supporting at least said rounded first semi-finished piece (2) consists in inserting at least said mold and rounded first semi-finished piece (2) into one of the counter-shaped imprints made in a throwaway matrix.

13. The process according to claim 1, characterized in that it comprises an operation of finishing with a magnetic sieve at least said first rounded semi-finished piece (2), performed after said operation of removing material which said ornamental pattern (5) is got with and before said operation of firmly coupling said shaped bottoms (4) with said semi-finished pieces (2, 3), suitable to remove residual portions of metallic material.

14. The process according to claim 1, characterized in pieces (2, 3) comprises a welding which is performed at the outer perimetric edge of that said operation of coupling said shaped bottoms (4) with said semi-finished said shaped bottoms (4) and said semi-finished pieces (2, 3) and at operating conditions depending on the type of metallic material with which said semi-finished pieces (2, 3) and said shaped bottoms (4) arc made of.

15. The process according to claim 14, characterized in that said welding takes place while keeping said semi-finished pieces (2, 3) and said shaped bottoms (4) slightly inclined with respect to a horizontal and vertical plane in such a way as to access prefixed welding zones in a manner more precise and localized and prevent the weld material of said welding interests and damages said ornamental pattern (5).

16. The process according to claim 14, characterized in that said operation of coupling said shaped bottoms (4) with said semi-finished pieces (2, 3) comprises an operation of applying a locking and shielding liquid at the zone surrounding said outer perimetric edge of said shaped bottoms (4) and said semi-finished pieces (2, 3), performed immediately before said operation of welding in order to limit its invasive, both thermal and mechanical, effects and prevent the weld material of said welding interests and damages said ornamental pattern (5).

17. The process according to claim 1, characterized in that said operation of firmly constraining together said half portions (6, 7) of said openable photograph holder (1) comprises the following operations:

welding a main ring (11) to a first of said shaped bottoms (4) in such, a way that said main ring (11) protrudes from the side edge (6*c*) of a first of said half portions (6, 7);

welding two auxiliary rings (12, 13) substantially coaxial and spaced apart each other to a second of said shaped bottoms (4) in such a way that said auxiliary rings (12, 13) protrude from the side edge (7*c*) of a second of said half portions (6, 7);

bringing said half portions (6, 7) near each other in such a way that said main ring (11) is interposed between said auxiliary rings (12, 13) and coaxial to them;

inserting a wire (14) into said main ring (11) and said auxiliary rings (12, 13);

welding the opposite ends of said wire (14) to said side edge (7*c*) of at least one of said half portions (6, 7) in such a way that the assembly thus obtained forms a rotation hinge (15).

18. The process according to claim 17, characterized in that said operation of rotatably constraining together said half portions (6, 7) comprises an. operation of applying a locking and shielding liquid at the area surrounding said rotation hinge (15), performed immediately before said operation of welding in order to limit its invasive thermal and mechanical effects.

19. The process according to claim 1, characterized in that said operation of final finishing consists of a brush polishing performed without any manipulation by the operator of said half portions (6, 7) constrained each other, temporarily positioning said half portions (6, 7) on support means.

20. The process according to claim 19, characterized in that it comprises an operation of applying a decorative shaped insert (18, 19), having a profile substantially equal to that one of said semi-finished pieces (2, 3) and said shaped bottoms (4), to said inner surface (6*b*,7*b*) of at least one of said half portions (6, 7) and an operation of fixing said decorative shaped insert (18, 19) to said inner surface (6*b*,7*b*) of at least one of said half portions (6, 7) by coupling with said inner surface (6*b*, 7*b*) a removable protection (20, 21) made of transparent material.

* * * * *